United States Patent [19]

Teng

[11] Patent Number: 4,600,062

[45] Date of Patent: Jul. 15, 1986

[54] SHOCK ABSORBING DRILLING TOOL

[75] Inventor: Chuan C. Teng, Houston, Tex.

[73] Assignee: 501 Dailey Petroleum Services Corporation, Conroe, Tex.

[21] Appl. No.: 630,777

[22] Filed: Jul. 13, 1984

[51] Int. Cl.[4] ..... E21B 17/07; F16D 3/06

[52] U.S. Cl. ..... 175/322; 464/20; 267/125

[58] Field of Search ..... 175/321, 322; 267/125, 267/137; 464/18, 20; 166/244 C

[56] References Cited

U.S. PATENT DOCUMENTS

| | | | |
|---|---|---|---|
| 1,767,350 | 6/1930 | Crowell | 175/321 |
| 2,325,132 | 7/1943 | Haushalter et al. | 175/321 |
| 2,570,577 | 10/1951 | Manion | 464/20 |
| 2,795,398 | 6/1957 | Ragland | 464/20 |
| 3,230,740 | 1/1966 | Fox | 464/20 |
| 3,301,009 | 1/1967 | Coulter, Jr. | 175/321 |
| 3,306,078 | 2/1967 | Hughes | 464/20 |
| 3,323,326 | 6/1967 | Vertson | 464/20 |
| 3,339,380 | 9/1967 | Fox | 464/20 |
| 3,345,832 | 10/1967 | Bottoms | 175/321 |
| 3,383,126 | 5/1968 | Salvatori et al. | 175/321 |
| 3,406,537 | 10/1968 | Falkner, Jr. | 464/20 |
| 3,858,669 | 1/1975 | Jeter | 175/322 |
| 3,884,051 | 5/1975 | Bottoms | 464/20 |
| 3,998,443 | 12/1976 | Webb | 267/125 |
| 4,162,619 | 7/1979 | Nixon, Jr. | 464/20 |
| 4,245,698 | 1/1981 | Berkowitz et al. | 166/244 C |
| 4,246,765 | 1/1981 | Zabcik | 464/20 |
| 4,257,245 | 3/1981 | Toelke et al. | 175/321 |
| 4,270,620 | 6/1981 | Lawrence | 175/322 |

*Primary Examiner*—Stephen J. Novosad
*Assistant Examiner*—Bruce M. Kisliuk
*Attorney, Agent, or Firm*—Arnold, White & Durkee

[57] ABSTRACT

A well tool carried in a drill string for maintaining bottom hole contact while absorbing angular and axial shock forces of a rotating drill bit. The tool has an elongated body with pipe joint ends and includes a tubular mandrel slideably mounted within a tubular barrel. A groove and roller connection guides the mandrel within the barrel during drilling. Resilient shock absorbing members between metal guide rings are carried between stop elements on the mandrel and barrel. Shock forces are absorbed by the telescoping movements of the mandrel within the barrel and by in the members acted on by the stop elements. The mandrel is formed of two pieces that threadedly connect to one another between the resilient shock absorbing members and the groove and roller connection. A lifting lug positioned above the rollers and below the shock absorbing members within an elongate mandrel groove, engages the joint to transfer the weight of the mandrel to the barrel upon withdrawal of the tool.

12 Claims, 3 Drawing Figures

SHOCK ABSORBING DRILLING TOOL

BACKGROUND OF THE INVENTION

1. Field of the Invention

This invention relates to well tools used in the rotary drilling of wellbores, and it more particularly relates to a shock absorber device.

2. Background Art

In the drilling of a wellbore, a rotary drill bit is employed for cutting away the formations being penetrated. The drill bit is suspended upon a drill string which can be of great length, e.g. 25,000 feet. Although the drill bit rotates at relatively low RPM, it can generate relatively large angular and axial shock forces that are applied to the drill string. These shock forces can cause physical injury to both the drill string and drill bit. Also, these shock forces may cause the drill bit to lose contact with the bottom of the wellbore. As a result, the drilling efficiency can suffer from even small axial displacements (e.g., one half inch) of the drill bit from contact with the formation being penetrated. Likewise, angular shocks produce serious variations in the torque applied to the drill bit which results in non-uniform formation penetration. Obviously, it is most desirable to prevent these angular and axial shock forces from being applied to the drill string or effecting the bottom hole contact of the drill bit.

Various well tools have been proposed to have either bottom hole contact or shock absorber functions. A few well tools have been proposed to provide a combination of such functions. In general, these combination tools use a helical connection in the well tool and a fluid dash pot or hydraulic cushion. As a result, these combination tools are very complex in construction and element functioning which leads to short operational lives, difficult field servicing, repairs and other undesirable results.

U.S. Pat. No. 4,443,206 to the inventor of the present invention provides a well tool maintaining bottom hole contact and absorbing shocks with a relatively simple construction, long life in well drilling and a relatively simple, easily repaired structure. However, it would be desirable to further increase the life of a tool of this kind.

SUMMARY OF THE INVENTION

In accordance with this invention, there is provided a well tool for maintaining bottom hole contact while absorbing angularly and axially directed shock forces of a rotating drill bit carried on a drill string. The tool has an elongated body with connections for threaded assembly into a string of well pipe. A tubular mandrel is slideably mounted in a tubular barrel formed in the body. An annular chamber isolated from well fluid is defined between the mandrel and the barrel. Resilient shock absorbing members between metal guide rings are carried in the chamber between stop means. The mandrel carries a plurality of elongate grooves in which ride rollers carried by the barrel so that the mandrel is controlled angularly in movement while telescoping within the barrel.

The shock forces across the body are initially absorbed by the telescoping movement of the mandrel in the barrel and also by action of the rollers within the grooves. These shock forces are also absorbed by the stop means acting on the resilient members.

The mandrel is formed of at least two pieces that threadedly connect to one another between the resilient shock absorbing members and the groove and roller connection. This makes possible the strengthening of the upper barrel joint and positions the barrel to mandrel connection in a lower stress position. In addition, it enables the weight of the mandrel to be transferred to the barrel at a more advantageous position along the tool length.

DESCRIPTION OF THE DRAWINGS

In the drawings, like parts will carry like numerals throughout the several views so as to simplify the description of the well tool employing the present invention.

DESCRIPTION OF THE PREFERRED EMBODIMENT

Figure 1:
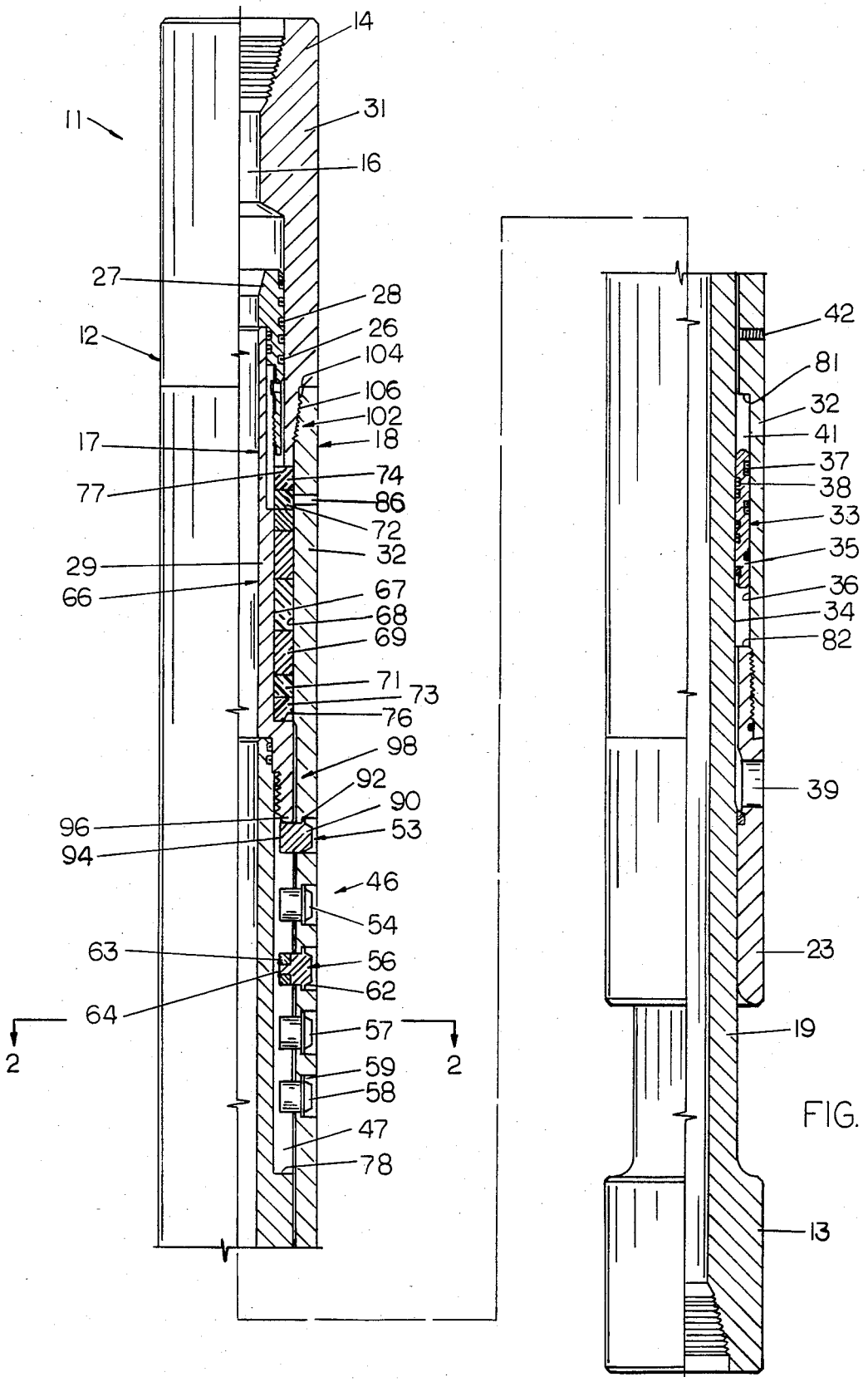
FIG. 1 is an elevation, partially in longitudinal section, of a preferred embodiment of the present well tool in the closed position.

Referring to the drawings, there is shown a preferred embodiment of the well tool 11 of the present invention. The well tool 11 is usually placed into a string of drill pipe (not shown), preferably adjacent the drill collars and above the rotary drilling bit. The well tool 11 is placed as close as convenient to the rotary bit to absorb the shock forces generated during drilling and also to maintain the drill bit in contact with the formation being penetrated. The well tool 11, as can be seen in FIG. 1, is comprised of a body 12 which carries threaded connections as for example, boxes 13 and 14 for interconnection into a string of well pipe. Usually, the box 13 receives the rotary drill bit while the box 14 threads into the superimposed well pipe string. However the boxes 13 and 14 may be arranged in other arrangements such as a pin and box arrangement, if desired. The body 12 has an axial flow passage 16 which extends between its ends to accommodiate flows of drilling fluid and the like.

The body 12 is formed of a tubular mandrel 17 that is slidably mounted within an exterior tubular barrel 18. The sliding interconnection may be provided at the upper part of the well tool by a cylindrical bearing surface 26 carried upon an upper section 27 of the mandrel 17. In addition, the upper section 27 may carry a plurality of fluid seals 28 which provide a leak proof sliding joint between the mandrel 17 and the barrel 18. The upper section 27 is threadedly mounted upon the central section 29 of the mandrel 17. Similarly, the upper section 31 of the barrel 18 may be threadedly connected to the center section 32 of the barrel 18 at the joint or connection 102.

The lower end of the body 12 carries a floating seal 33 which is slideably contained within an annular chamber defined by cylindrical wall surfaces 34 and 36 between the mandrel and barrel, respectively and by end walls 81 and 82. More particularly, the seal 33 is formed of an annular metal sleeve 35 containing a plurality of interior and exterior grooves. Seal rings 37 and 38 in the grooves provide the dynamic sealing function between the seal sleeve 35 and the adjacent surfaces 34 and 36 of the mandrel and the barrel. The annulus below the seal 33 is exposed to well fluids through a lower port 39 that is formed in the lower section 23 of the barrel 18. The lower section 23 is threadedly connected to the center section 32 of the barrel 18 and the lower section 19 of the mandrel 17 is threadedly connected to the central section 29 of the mandrel 17 at the joint or connection 98.

The seals 28 of the upper section 27 of the mandrel 17 and the floating seal 33 define an annular chamber 41 which is isolated from the well fluids surrounding the well tool 11. The chamber may be filled with an oil. The floating seal 33 functions to maintain the oil in the chamber 41 at substantially the same hydrostatic pressure as the well fluid which surrounds the well tool 11. As a result, the upper and lower seals upon the body 12 function at substantially no pressure differential which ensures their long life in rotary and sliding movements between the mandrel 17 and the barrel 18. The chamber 41 may be filled with oil through a plug port 42 that is carried in the center section 32 of the barrel 18. With this arrangement of the seals and bearing surfaces, the mandrel 17 can have both rotational and telescoping movements relative to the barrel 18 while the chamber 41 maintains a substantial uniform volumetric capacity and remains at substantially the hydrostatic pressure of the well fluid which surrounds the well tool 11.

Figure 2:
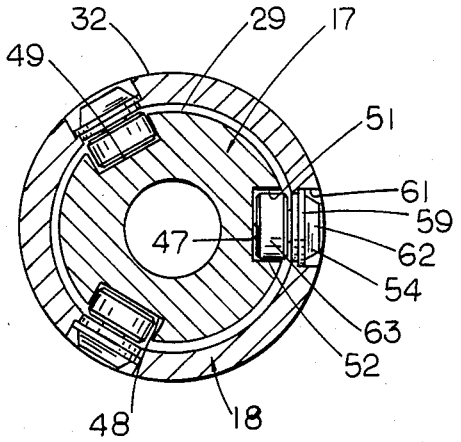
FIG. 2 is an enlarged cross-section taken along line 2—2 of the well tool shown in FIG. 1.

The body 12 of the well tool carries a mechanism for maintaining the drill bit substantially in contact with the formation being penetrated during drilling operations. For this purpose, the lower section 19 of the mandrel 17 carries a plurality of grooves that extend longitudinally for some distance in its exterior surface. The region of these grooves is designated by the numeral 46. For example, as seen in FIG. 2, the mandrel 17 may carry three grooves 47, 48 and 49; however, the number of grooves may vary. These grooves preferably have a tangential flat bottom with sidewalls that are parallel to the diameter of the mandrel which passes centrally through the bottom of the groove. The groove 47, shown in FIGS. 2 and 3, has a flat bottom 50 with sidewalls 51 and 52 parallel to the diameter which passes through the center of the mandrel 17 and the groove. While straight grooves are illustrated, other groove configurations, including helical grooves may be used as well.

Figure 3:
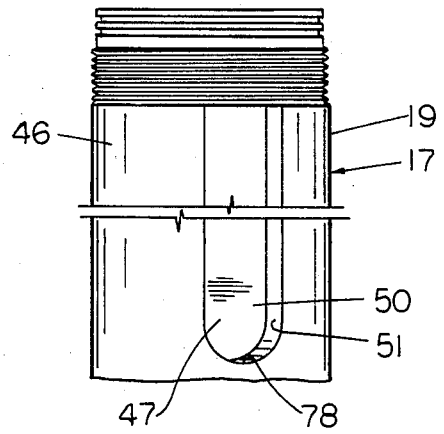
FIG. 3 is an enlarged partial elevation of the mandrel showing an elongate groove as used in the present well tool.

Referring to FIGS. 1, 2 and 3, the barrel 18 in the center section 32 carries in longitudinally aligned openings a plurality of rollers which extend inwardly and drivably engage within the grooves 47, 48, or 49. Preferably, there are several rollers in each of the grooves, such as the rollers 54, 56, 57 and 58 within the groove 47.

All the rollers have identical mountings in the barrel 18. Referring to FIG. 2, the rollers 54–58 are each received within a stepped opening 61 formed within the center section 32 of the barrel. The rollers 54–58 each have a body 62 that is secured within the opening 61 by any convenient means, such as by a small welded bead 59 at its peripheral edge within the opening 61. Extending radially inwardly from the body 62 is a roller bearing 63 which is rotatably carried on a bearing mount portion 64 of the body 62, as can be seen in FIG. 1. The diameter of the bearing 63 is slightly less than the width of the grooves to allow some rotary movement of the mandrel with respect to the barrel. It will be apparent that the rollers 54–58 engage one of the side surfaces 51 or 52 of the groove 47. During normal drilling operations, the rollers ride upon the forward face 52 because of the right hand rotation of the well drill string. As a result, the mandrel 17 is urged to rotate in the same direction. Preferably, there are a like plurality of rollers carried in the barrel 18 within each of the grooves 47, 48 and 49. Thus, there is a like number, placement and symmetry of the rollers to engage the several grooves in the mandrel 17. As a result, there is a uniform driving force transmitted between the barrel and the mandrel during rotary drilling operations.

In addition to the rollers 54–58, a lifting lug 53 also rides within each groove 47, 48 and 49. The lug 53 includes a head 90 maintained by a rim 92 within the barrel 18, and a stalk 94 that extends into the groove 47, 48 or 49 in the mandrel 17. The stalk 94 abuts with the radially outwardly off-set, L-shaped internally threaded, lower end portion 96 of the central section 29 of the mandrel 17 adjacent the connection 98. Thus, the weight of the mandrel 17, for example, on withdrawal of the tool 11, is transferred to the barrel 18 across the lug 53. The lateral dimension of the lug 53 is slightly less than the width of the groove 47, 48 or 49, as shown in FIG. 2, to allow lateral play between the lug 53 and the mandrel 17. However, the eccentric relationship between head 90 and the stalk 94 prevents rotation of the lug 53. In addition, the lug 53 is welded to the barrel.

Movement of the well drill string or the well bit relative to the bottom of the well bore, causes the mandrel 17 to telescope within the barrel 18. Thus, the several rollers 54–58 and lug 53 ride up or down within the grooves depending upon the relative movements between the mandrel and the barrel.

The described arrangement of the grooves and rollers provide a telescoping movement relationship between the mandrel and the barrel. It will be apparent that the shock forces arising from the rotary drill bit, (or from other portions of the well drill string), are absorbed at least in part by the mandrel moving through the action of the rollers riding within the grooves.

The well tool 11 carries a resilient shock absorber element 66 between the mandrel 17 and the barrel 18. Thus, the rollers can travel a predetermined distance within the grooves. However, the relative movements of the mandrel 17 to the barrel 18 will be brought to a stop in less than this predetermined distance by the action of the shock absorber element 66. An arrangement may be employed for the shock absorber element 66 which can stop the telescoping inward movement of the mandrel within the barrel 18 in a controlled manner without the abruptness of a metal-to-metal contact such as found in downhole jar tools employed in rotary drilling practices.

More particularly, the shock absorber element 66 can be a rubber sleeve contained within a chamber formed between the cylindrical sidewalls 67 and 68 of the opposing faces of the mandrel 17 and barrel 18. Preferably, the shock absorber element 66 is provided by a plurality of annular resilient members 69 which are arranged in a stack to substantially fill this chamber. At each end of the resilient member 69 are carried crossover rings 71 and 72, and metal guide rings 73 and 74 to complete the element 66.

More particularly, the resilient members 69 are constructed of any suitable shock absorbing medium, such as the natural or synthetic rubbers. The synthetic rubbers of the silicone variety provide good service in the present well tool where high downhole temperatures may be encountered. However, the members 69 can be modeled from the rubber material used in prior art shock absorber devices associated with the well drilling industry. The guide rings 73 and 74 are of a relatively hard metal and may be steel or brass. The function of these metal guide rings is in maintaining alignment of the crossover rings and resilient members 69 as the mandrel 17 telescopes inwardly and outwardly within the barrel 18. There may be times when the resilient member 69 and the associated crossover and guide rings are spread apart and then returned into engagement for absorbing axial and angular shock forces. Thus, the guide rings must maintain the alignment of the other associated components of the shock absorber element 66 during the inward and outward telescoping of the mandrel in the barrel.

The shock absorber element 66 is arranged for functioning with the inward movement of the mandrel 17 within the barrel 18 by a stepped shoulder 76 that is formed within the center section 29 of the mandrel and a stepped shoulder 77 formed upon the end of the upper section 31 of the barrel 18. Thus, as the mandrel 17 telescopes inwardly within the barrel 18, the shoulders engage the metal guide rings and compress the resilient member 69 until the shock forces are absorbed therein. While the rollers and grooves absorb a first portion of the shock forces, the resilient members 69 absorb the rest of such shock forces. Since the mandrel undergoes substantial axial movement relative to barrel 18, it is preferred that the resilient members 69 have a relatively loose fit between the mandrel and the barrel. For example, the annular resilient members 69 may have a clearance between the wall surfaces 67 and 68 of 20 thousandths of an inch or greater. Thus as the axial and angular shock forces are absorbed within the resilient members 69, they are compressed and distorted outwardly during their functioning in the tool 11.

In addition, oil contained within the chamber 41 is trapped between the various elements forming the resilient element 66. This trapped oil tends to form a hydraulic cushion during the functioning of the shock absorber element 66.

It will be apparent that large magnitude forces are involved in operation of the well tool 11. As a result, the components of the shock absorber element 66 will wear. This wearing of the resilient members 69 is significantly reduced by the crossover rings 71 and 72 that are employed in the element 66.

More particularly, the crossover rings are formed of a particular bearing material that has a compressive yield between the compressive yield of the resilient members 69 and the compressive yield of the metal guide rings 72 and 73. For this purpose, it is preferable to form the crossover rings from a polymeric material, of the reinforced variety, such as graphite filled Teflon. A ring constructed of this material may have a rectangular cross section to serve as a rotary bearing while also exhibiting yielding properties which protect the resilient members 69 from being frayed or otherwise injured by impacts from the metal guide rings during compression of the shock absorber element 66.

The well tool 11 is shown in FIG. 1 in its inward or closed condition where the resilient element 66 is engaged between the shoulders 76 and 77 of the mandrel and barrel, respectively. In the open or outward condition the resilient element 66 is forced into a compressive state by engagement with a shoulder 77 carried upon the upper section 31 of the barrel 18, and the shoulder 76. The resilient element 66 functions in the same manner in the open tool condition as it did in the closed position shown in FIG. 1. The shoulders 76 and 77 provide positive mechanical stops for energizing the resilient element 66 when the mandrel 17 is telescoped with respect to the barrel 18.

If the well tool 11 is operated for a sufficiently long period of time in rotary drilling operations, the resilient members 69 may be worn very substantially in their axial and radial dimensions. Ultimately, the stack of these members 69 between the crossover and guide rings may be so shortened that their shock absorbing function is substantially eliminated from the well tool 11. However, the tool 11 cannot suffer damage when the resilient shock absorber element 66 ceases to function. This is because the lowermost roller 58 acts as a positive mechanical stop against the ledge 78 preventing excessive relative movement between the barrel and the mandrel.

The well tool 11 is assembled in a conventional fashion through the threaded interconnection of the several sections of the mandrel 17 and barrel 18. If desired, the chamber 41 is preferably filled through the plugged filling port 42 with the tool in a horizontal position. It desired, the air trapped within the chamber 41 may be vented through an auxiliary or air vent plugged port 86 which is provided adjacent the upper section 31 of the mandrel 17. Other assembling and filling techniques of the tool may be employed, if desired.

The well tool 11 is well suited for providing the combined function of ensuring bottom hole contact of a rotary drill bit with the formation being penetrated while absorbing the angular and axial shock forces generated by the rotating drill bit, or the other components of the well drill string which contain the present tool. The grooves and rollers provide a dual functioning in absorbing shock forces while maintaining the drill bit in contact with the formation being penetrated. In addition, shock forces in excess of those accommodated by the grooves and rollers are absorbed in a resilient sleeve or element contained between positive mechanical stops carried on the mandrel and barrel of the tool.

The positioning of the connection 98 along the length of the tool 11 between the shock absorber element 66 and the roller connection 46 has a number of important advantages. At this position, the connection 98 and the mandrel section 29 are not exposed to the high torque and stress loads arising during drilling and the high stress loads arising due to the weight of tool, for example, upon withdrawal. This is because these loads are transferred from the barrel 18 to the mandrel 17 and from the mandrel 17 to the barrel 18, below the connection 98 at the lug 53 or rollers 54–58. The high torque and stress drilling loads are transferred to and from the mandrel and barrel by the rollers while the high stress weight loadings, upon withdrawal of the tool, are transferred by the lug 53. Thus, the tool 11 is effectively strengthened in a very economical fashion.

Moreover, this positioning of the connection 98 enables the strengthening of the connection 102 between the barrel portions 31 and 32. Since the mandrel portion 19 must be relatively thick due to the high loads experienced in this region, locating the connection 98 just above the load transfer point, the lug 53 and rollers 54–58, enables the mandrel section 29 to be thinner. This in turn enables the barrel portion 31 which is exposed to higher loading, to be thicker. It also makes more feasible the inclusion of a stress relief 104 at the inner end of the threaded portion 106 of the barrel portion 31. Further, the L-shaped end portion 96 acts as a stop for both the shock absorbing element 66 and lug 53.

The life of the tool 11 may be further extended by coating exposed tool surfaces with a corrosion resistant coating. Particularly in drilling environments where the tool 11 may be exposed to hydrogen sulphide or unbalanced potassium chloride mud, surface corrosion may limit the tool's useful life. Thus, the surfaces of the mandrel 17 and barrel portions 31 and 32 are advantageously coated with a corrosion resistant material such as a nickel plated base covered by hard chrome. The nickel plated base may be formed from nickel or a chrome/nickel alloy.

It will be appreciated that certain changes or alterations in the present well tool may be made without departing from the spirit of this invention. These changes are contemplated by and are within the scope of the appended claims which define this invention. Additionally, the present description is intended to be taken as an illustration of this invention.

What is claimed is:

1. A shock absorber for a drill string comprising:

an elongated body having threaded connections at its ends for assembly into a string of well pipe carrying a drill bit, said body having an axial flow passageway;

said body formed of a tubular mandrel slideably mounted within a tubular barrel with an annulus exposed to well fluid between said mandrel and said barrel;

fluid seals positioned in the annulus between said mandrel and said barrel forming an annular region isolated from well fluid;

said mandrel and said barrel each having opposed shoulders defining a cylindrical chamber in the fluid isolated annular region;

bearing means for providing telescoping movements of said mandrel in said barrel;

a plurality of grooves extending longitudinally on said mandrel;

rollers carried by said barrel and driveably engaged within said grooves whereby said mandrel telescopes with respect to said barrel;

annular resilient shock absorbing members contained as a stack in said cylindrical chamber; and said mandrel including at least two sections threadedly connected at a joint located between said rollers and said shock absorbing members.

2. The shock absorber of claim 1 including cylindrical metal guide rings at each end of the stack of said members.

3. The shock absorber of claim 2 including cylindrical crossover rings interposed between said guide rings and the stack of said members whereby the telescoping of said mandrel in said barrel is limited by said members acted upon by said guide rings and crossover rings, and said crossover rings providing a fluid seal between said mandrel and said barrel and a transitional yielding cushion and rotary bearing between said metal guide rings and said members while being axially loaded within said chamber.

4. The shock absorber of claim 1 wherein said grooves are in a straight, longitudinally oriented configuration.

5. The shock absorber of claim 1 wherein one fluid seal is a floating seal between said mandrel and said barrel whereby the hydrostatic pressure in the well bore is maintained in said cylindrical chamber.

6. The shock absorber of claim 1 including stop means for limiting by said annular resilient shock absorbing members the telescoping movement of said mandrel in said barrel during rotation of the drill string whereby shock forces across said body are absorbed by the telescoping movement of said mandrel in said barrel along said grooves and by the stack of said members within said chamber.

7. The shock absorber of claim 1 wherein surfaces of said absorber are coated with a corrosion resistant material.

8. The shock absorber of claim 7 wherein said material includes a nickel base covered by hard chrome.

9. The shock absorber of claim 1 wherein said barrel includes at least two threadedly connectable pieces forming a connection above said shock absorbing members, said connection including a stress relief.

10. The shock absorber of claim 1 including a lifting lug, secured on said barrel above said rollers and below said shock absorbing members and extending into a groove in said mandrel.

11. The shock absorber of claim 10 wherein said joint defines a lower stop for said shock absorbing members and an abutment for said lifting lug, such that the weight of said mandrel is transferred to said barrel through said lifting lug upon withdrawal of the drill string.

12. The shock absorber of claim 11 wherein the upper of said two sections threadedly connected at said joint has a radially outwardly offset, internally threaded lower end portion that threadedly connects to the other of said two sections to form said joint.

* * * * *